US006977640B1

(12) United States Patent
Baek et al.

(10) Patent No.: US 6,977,640 B1
(45) Date of Patent: Dec. 20, 2005

(54) DISPLAY APPARATUS FOR NOTEBOOK COMPUTER

(75) Inventors: Young Sang Baek, Kyungki-do (KR); Yu Soong Kim, Inchun-si (KR); Seong Jin Kim, Seoul (KR); Kyong Seok Kim, Kyungki-do (KR)

(73) Assignee: LG Philips LCD Co., Ltd., Seoul (KR)

( * ) Notice: Subject to any disclaimer, the term of this patent is extended or adjusted under 35 U.S.C. 154(b) by 526 days.

(21) Appl. No.: 09/137,842

(22) Filed: Aug. 21, 1998

(30) Foreign Application Priority Data

| | | |
|---|---|---|
| Aug. 21, 1997 | (KR) | P97-39903 |
| Sep. 15, 1997 | (KR) | P97-48017 |
| Apr. 22, 1998 | (KR) | P98-14411 |
| Apr. 22, 1998 | (KR) | P98-14412 |

(51) Int. Cl.[7] ..... G09G 3/36
(52) U.S. Cl. ..... 345/102; 345/211; 345/213
(58) Field of Search ..... 345/102, 211, 213; 349/149, 150

(56) References Cited

U.S. PATENT DOCUMENTS

| | | | | |
|---|---|---|---|---|
| 5,546,098 | A * | 8/1996 | Moriconi | 345/204 |
| 5,736,973 | A * | 4/1998 | Godfrey et al. | 345/102 |

FOREIGN PATENT DOCUMENTS

| | | | |
|---|---|---|---|
| JP | 63033665 | A | 2/1988 |
| JP | 63111474 | A | 5/1988 |
| KR | 10-0299388 | | 10/2001 |

* cited by examiner

*Primary Examiner*—Patrick N. Edouard
*Assistant Examiner*—Duc Q Dinh
(74) *Attorney, Agent, or Firm*—Fleshner & Kim, LLP

(57) ABSTRACT

A display apparatus that has a light and thin panel module to be capable of preventing noise. In the display apparatus, the row and source drivers for driving the display panel is controlled by the timing control board which is positioned on main printed circuit board of the notebook computer body. The timing control board is connected with the row and source drivers by the flexible printed circuit film.

10 Claims, 24 Drawing Sheets

DISPLAY APPARATUS FOR NOTEBOOK COMPUTER

BACKGROUND OF THE INVENTION

1. Field of the Invention

The present invention relates to a notebook personal computer with a display apparatus, and particularly to a display apparatus having a display panel and a driving circuit board for driving the display panel. Also, the present invention relates to a flexible printed circuit film for connecting the display panel with the driving circuit board.

2. Description of the Prior Art

Generally, the display apparatus used in notebook computer (hereinafter "NTPC") is composed of the display panel having a pixel (picture element) matrix and panel driving circuits for driving the display panel. The panel driving circuits drive the pixel matrix so that picture information processed in a central processing unit (hereinafter "CPU") is displayed on the display panel. Actually, the display apparatus for the NTPC includes a liquid crystal panel 10, a plurality of row drivers 12 and a plurality of source drivers 14, as shown in FIG. 1. The liquid crystal panel 10 includes the pixel matrix formed between two glass substrates (not shown). The row drivers 12 drive sequentially row lines GL of the pixel matrix, and the source drivers 14 perform a function of supplying data signals to the column lines CL of the pixel matrix. In the display apparatus, a timing control board 16 is provided to receive signals from a graphic control board 18 included in a NTPC body 20. The graphic control board 18 converts graphic data into video data to be adaptable for displaying on the liquid crystal panel. The video data consists of red (hereinafter "R"), green (hereinafter "G") and blue (hereinafter "B") data. These R, G and B data are applied to the source drivers 14 through a first flexible printed circuit film (hereinafter "FPC film") 11, the timing control board 16 and a data bus 13. The graphic control board 18 also generates a main clock signal, a vertical synchronous signal and a horizontal synchronous signal to be supplied via the first FPC film 11 to the timing control board 16. The timing control board 16 generates timing signals for controlling the timing of the row and source drivers 12 and 14 on the basis of the main clock signal, vertical and horizontal synchronous signals. The timing signals are supplied to the row and source drivers 12 and 14 through control lines 15. In addition to the timing signals, the timing control board 16 generates panel voltage signals such as a common voltage signal and so on, gamma compensation voltage signals, and high and low voltage signals for a gate pulse. The gamma compensation voltage signals are applied to the source drivers 14, the high and low voltage signals are supplied to the row drivers 12. The panel driving voltage signals are transmitted to the liquid crystal panel 10, row and source drivers 12 and 14. To this end, in the timing control board 16 includes a timing control circuit chip for performing the data interface and the timing control, a gamma compensation voltage generating circuit for generating the gamma compensation voltage, a scan voltage generating circuit for generating the high and low voltage signals, and a power supply for generating the panel driving voltage signals.

In case of adapting the display apparatus having such circuitry structure to the NTPC, the graphic control board 18 is mounted on a main printed circuit board (hereinafter "MPCB") of a NTPC body 20, and the display panel 10, the row and source drivers 12 and 14, and the timing control board 16 are provided to a panel module 22 separated from the NTPC body 20. The panel module 22 further includes a back light unit 24 for irradiating lights to the liquid crystal panel 10 and a back light driver 26 for driving the back light unit 24.

The back light driver 26 responds to signals from the MPCB through second FPC film 17 and generates an AC (alternative current) voltage signal to be applied to back light unit 24 through a voltage signal line 19, responding to the light control signal LCS. To this end, the back light driver 26 consists of a chopper 30, inverter 32, transformer 34, and coupling capacitor C1 connected serially between the second FPC film 17 and a back light lamp 28, and a lamp current detector 36 and a brightness controller 38 coupled electrically to the chopper 30. The chopper 30 switches the DC (Direct Current) voltage signal Vbl to be supplied from the second FPC to the inverter 32 in accordance with a light control signal LCS from the second FPC film 17. Also, the chopper 30 adjusts the voltage level of the DC voltage signal responding to output signals of the lamp current detector 36 and brightness controller 38. The inverter 32 converts the DC voltage signal from the chopper 30 into the AC voltage signal, and the transformer 34 boosts the AC voltage signal from the inverter 32. The AC voltage signal boosted by the transformer 32 is applied to the back light lamp 28 through the coupling capacitor C1. The coupling capacitor C1 blocks out a DC component included in the boosted AC voltage signal. The coupling capacitor C1 and the lamp current detector 36 are connected to the back light lamp 28 by the voltage signal line 19 shown in FIG. 1.

Also, the panel module 22 having the circuitry structure as described above, is formed in the shape as shown in FIGS. 3A and 3B. In the FIGS. 3A and 3B, the NTPC body 20 is provided with a main housing 20A having the MPCB 20B. The MPCB 20B has the graphic control board 18 fixed thereon. The panel module 22 includes the liquid crystal panel 10, third and fourth FPC films 21 and 23. The liquid crystal panel 10 is provided with the timing control board 16, row and source drivers 12 and 14, and back light driver 26. The row drivers 12 and source drivers 14 are arranged at the left and bottom edges of the upper surface of the liquid crystal panel 10, respectively. The timing control board 16 coupled electrically with the graphic control board 18 by the first FPC film 11 is positioned at the left edge of the lower surface of the liquid crystal panel 10. The third FPC film 21 connects the timing control board 16 with the row and source drivers 12 and 14. To this end, the third FPC film 21 consists of the data bus 13 and the control lines 15 as shown in FIG. 1. The back light driver coupled electrically with the MPCB 22B by the second FPC film 17 is positioned at right side of the liquid crystal panel 10. The voltage line 19 connects the back light driver 26 with the back light unit 24 (not shown).

In the display apparatus as above mentioned, since the graphic control board 16 and the timing control board 18 are arranged in NTPC apart from each other, the R, G and B data, the synchronous signals and the clock signal are greatly affected by noise. Due to this, the picture displayed by the conventional display apparatus will be correspondingly distorted.

To minimize the influence of noise, a low noise display apparatus as shown in FIG. 4, is provided with a low noise display apparatus having a scanning transmitter 40 and a scanning receiver 42. The scanning transmitter 40 is positioned in the NTPC body 20 to be connected between the graphic control board 18 and the first FPC film 11, while the scanning receiver 42 is disposed in the panel module 22 to be connected between the first FPC film 11 and the timing control board 16. The graphic control board 18 is connected to the MPCB of the NTPC body 20 through a computer interface bus 20C. The graphic control board 18 receives the graphic data processed by the MPCB and generates the R, G and B data, the main clock signal, and the vertical and horizontal synchronous signals to be applied to the scanning transmitter 40. The scanning transmitter 42 encodes the signals from the graphic control board 18 into a specific format of signals which are not affected by noise. The specific format signals encoded by the scanning transmitter 40 is supplied via the first FPC film 11 to the scanning receiver 42. The scanning receiver 42 decodes the specific format signals from the scanning transmitter 40 and recovers the R, G and B data, which are applied to the source drivers 14 through the timing control board 16. The timing control board 16 generates the timing control signals to be transmitted to the row and source drivers 12 and 14, on the basis of the main clock signal, the vertical and horizontal synchronous signals from the scanning receiver 42. It is to be understood that the detailed description regarding to the timing control board 18, liquid crystal panel 10, row and source drivers 12 and 14, back light unit 24 and back light driver 26 can be indicated by the previously disclosed FIG. 1. In the low noise display apparatus having the scanning transmitter and receiver 40 and 42, there is no apparent distortion of picture as the signals transmitted from the graphic control board 18 to the timing control board 16 are not affected by noise.

In the NTPC with the low noise display apparatus, the panel module 20 is pivotally secured at the rear edge on the top portion of the NTPC body 20, as shown in FIGS. 5 and 6. Referring to FIGS. 5 and 6, the NTPC body 20 includes a main housing 20A loaded with the MPCB 20B, and a keyboard 20C. Arranged On the MPCB 20B included in the NTPC body 20, are the graphic control board 18 and the scanning transmitter 40. In the panel module 22, a panel housing 22A is provided with the back light unit 24, liquid crystal panel 10 and a window frame 22B composed in multi-layers. The liquid crystal panel 10 consists of a lower and upper glass substrates 10A and 10B and a pixel matrix 10C between the lower and upper glass substrates 10A and 10B. The lower glass substrate 10A is provided with the row and source drivers 12 and 14 and the third FPC film 21 for connecting the drivers 12 and 14 with an printed control board 44. The row drivers 12 are arranged on the left edge of the surface of the lower glass substrate 10A, the source drivers 14 are positioned on the bottom edge of the surface of the lower glass substrate 10A. The printed control board 44 has the timing control board 16 and the scanning receiver 42 connected with the first FPC film 11. The timing control board 16 drives the row and source drivers 12 and 14 responding to the signals from the scanning receiver 42. The scanning receiver 42 transmits the signals from the first FPC film 11 to the timing control board 16. The printed circuit board 44 with the timing control board 16 and scanning receiver 42, is mounted by the third FPC film 21 between the back light unit 24 and the bottom surface of the panel housing 22A. The first FPC film 11 connects the scanning receiver 42 with the scanning transmitter 40 disposed on the MPCB 20B of the NTPC body 20. Further, in the panel module 20, the back light driver 26 secured at right side of the lower glass substrate 10A is provided with the second FPC film 17. The back light driver 26 applies the AC voltage signal via the voltage line 19 to the back light unit 24 responding to the light control signal from the second FPC film 17. The second FPC film 17 connects the back light driver with the MPCB 22B of the NTPC body 20.

In the low noise display apparatus as described the above, since the timing control board 16 and the scanning receiver 42 are mounted on the panel module 22, the panel module is thick and the number of elements and contacts are large. As a result, the construction and fabricating process of the display apparatus are complex and the reliability of the display apparatus drops off. Also, in the display apparatus, the effective screen area is small and the FPC film is complex, because the back light driver is positioned at the right side of the liquid crystal panel.

SUMMARY OF THE INVENTION

Accordingly, it is an object of the present invention to provide a display apparatus having a light and thin panel module which is capable of preventing noise.

It is other object of the present invention to provide a display apparatus having a panel module which is capable to increase the effective screen area.

It is another object of the present invention to provide a flexible printed circuit board film which is adapted to the above display apparatus.

In order to obtain said object of the invention, a display apparatus for the notebook computer according to one aspect of the present invention, as broadly defined and embodied herein, includes: a display panel for displaying a picture information processed by the main printed circuit board of the computer body and having a pixel matrix; drivers being mounted on the display panel and for driving the row and column lines of the pixel matrix; panel driving unit on the main print circuit board for controlling the drivers in accordance with a picture data from the main printed circuit board; and a flexible printed circuit film for connecting the drivers with the panel driving unit.

A display apparatus for a notebook computer according to another aspect of the present invention includes: a panel module including a display panel and a back light unit for irradiating to the display panel, said display panel displaying a picture information processed by the main printed circuit board and having a pixel matrix; drivers being mounted on the display panel and for driving the row and column lines of the pixel matrix; a module control board for driving the drivers and the back light unit responding to signal from the main printed circuit board; a first connecting device connecting the drivers and back light unit with the module control board; and a second connecting device connecting the main printed circuit board with the module control board.

A display apparatus for a notebook computer according to further aspect of the present invention includes: a panel module including a display panel and a back light unit for irradiating to the display panel, said display panel displaying a picture information processed by the main printed circuit board and having a pixel matrix; drivers being mounted on the display panel and for driving the row and column lines of the pixel matrix; a module control board being mounted on the main printed circuit board for driving the drivers and the back light unit responding to signal from the main printed circuit board; and a connecting circuit connecting the drivers and back light unit with the module control board.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF PREFERRED EMBODIMENTS

Figure 1:
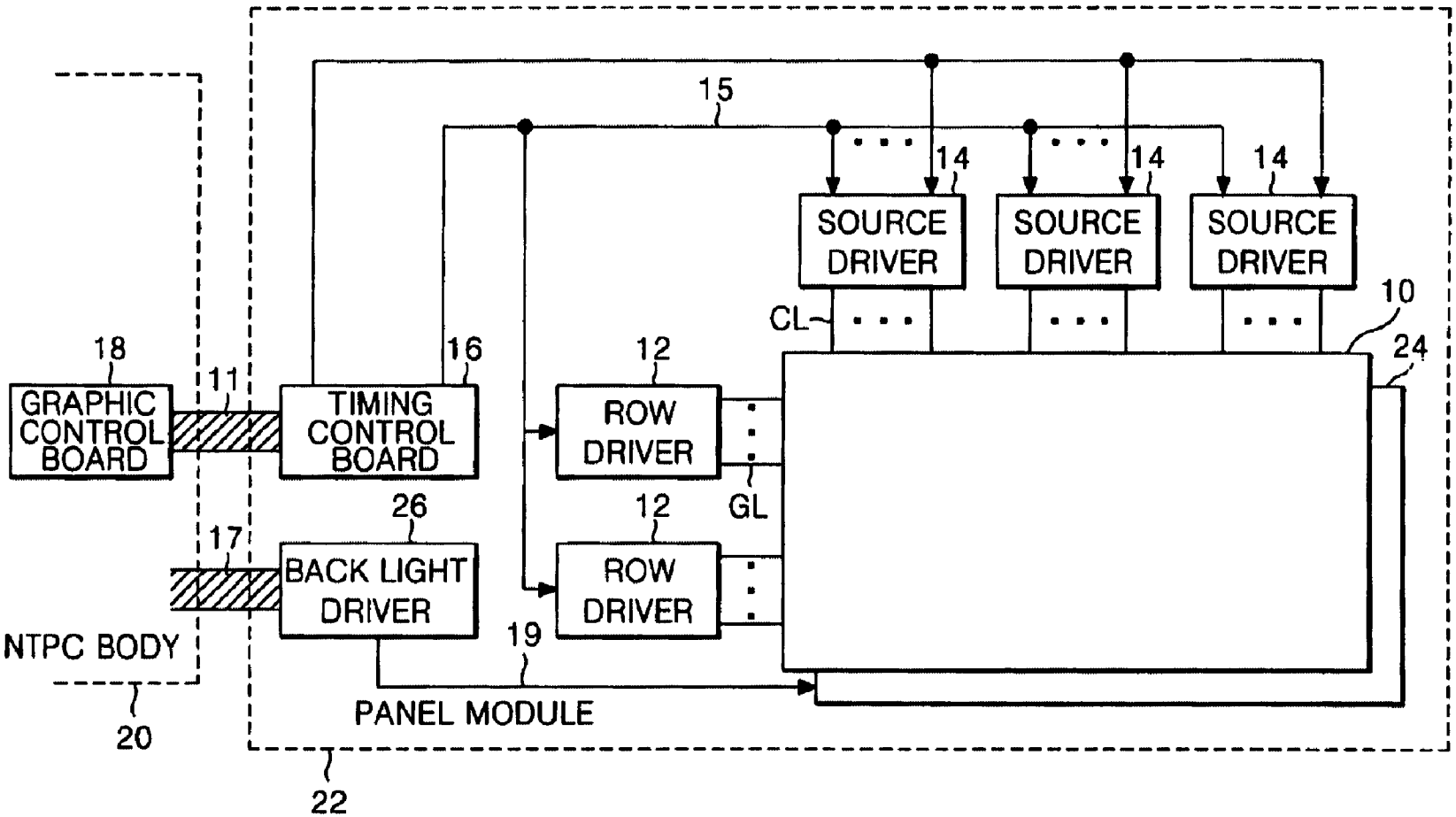
FIG. 1 PRIOR ART
FIG. 1 is a block diagram showing a NTPC with a prior display apparatus.
Figure 2:
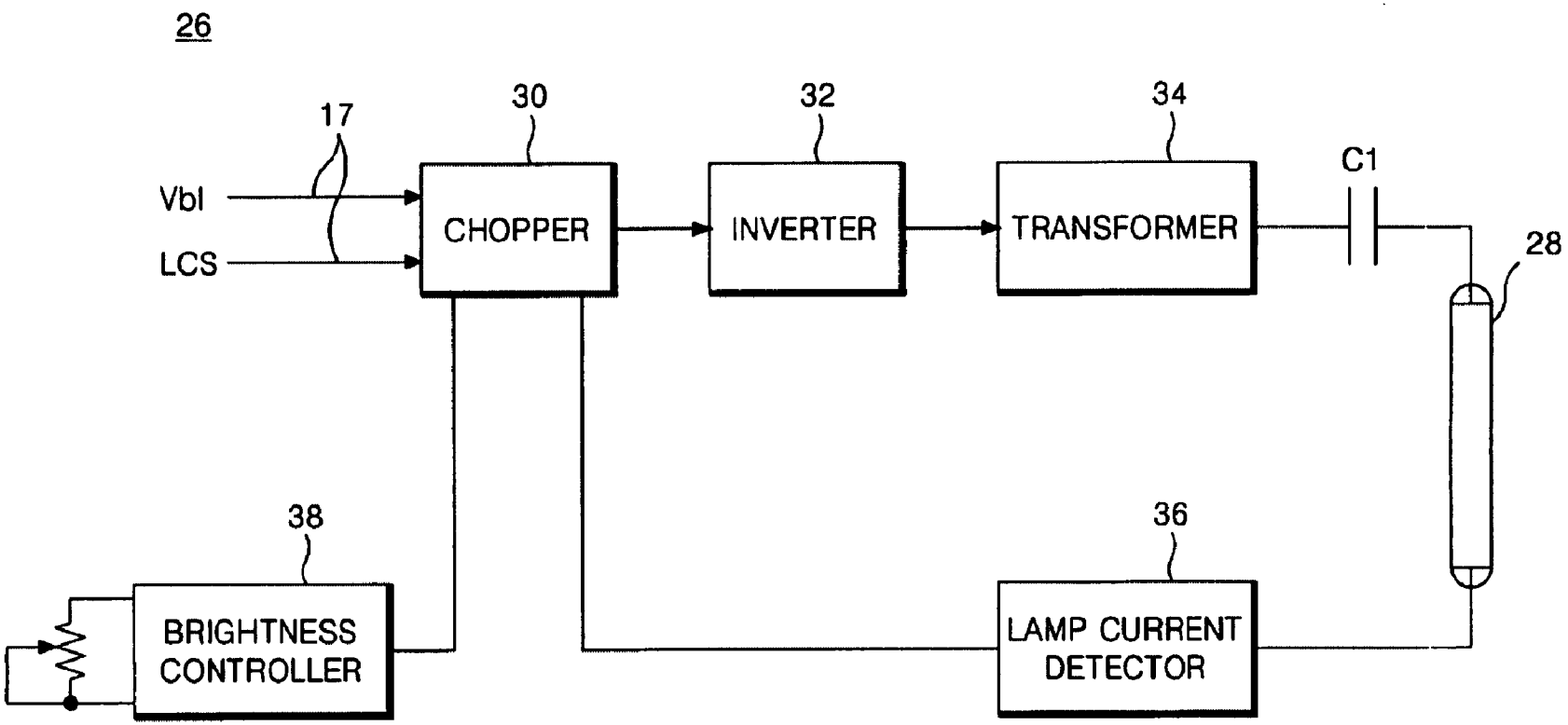
FIG. 2 PRIOR ART
FIG. 2 is a detailed block diagram of the back light driver shown in FIG. 1.
Figure 3A:
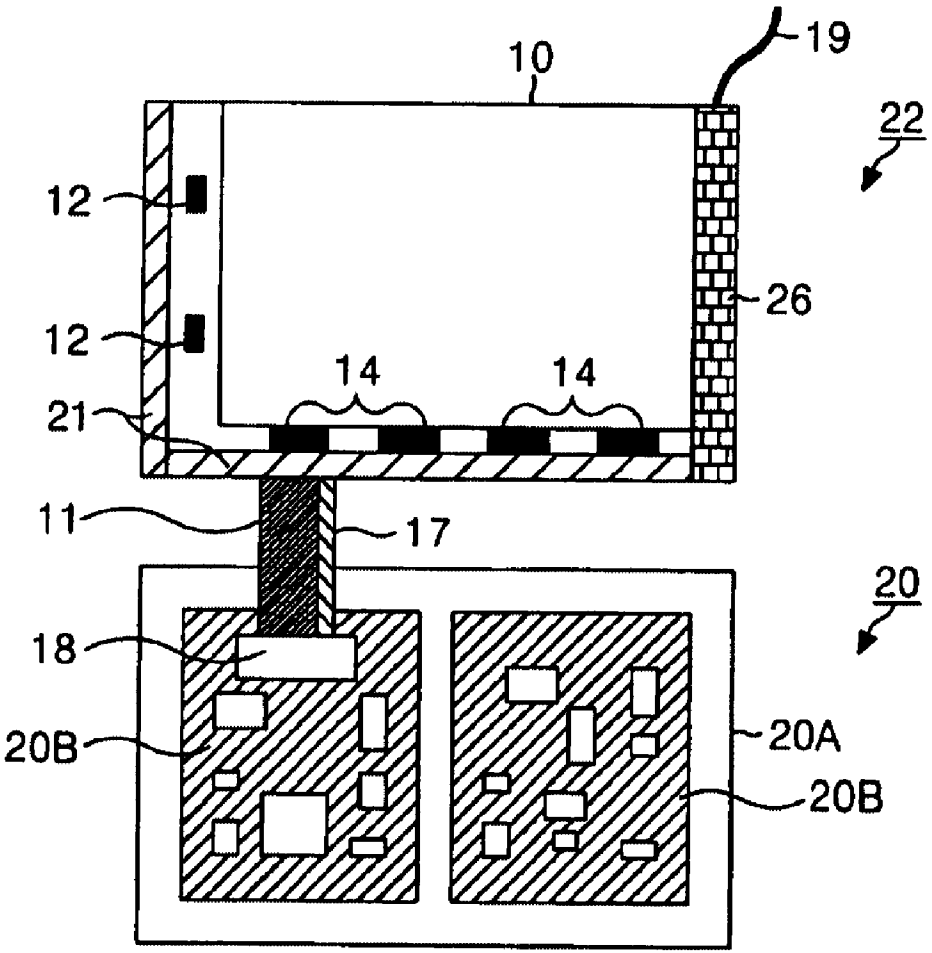
FIG. 3A PRIOR ART
FIG. 3A is a planar view for explaining the structure of the NTPC shown in FIG. 1.
Figure 3B:
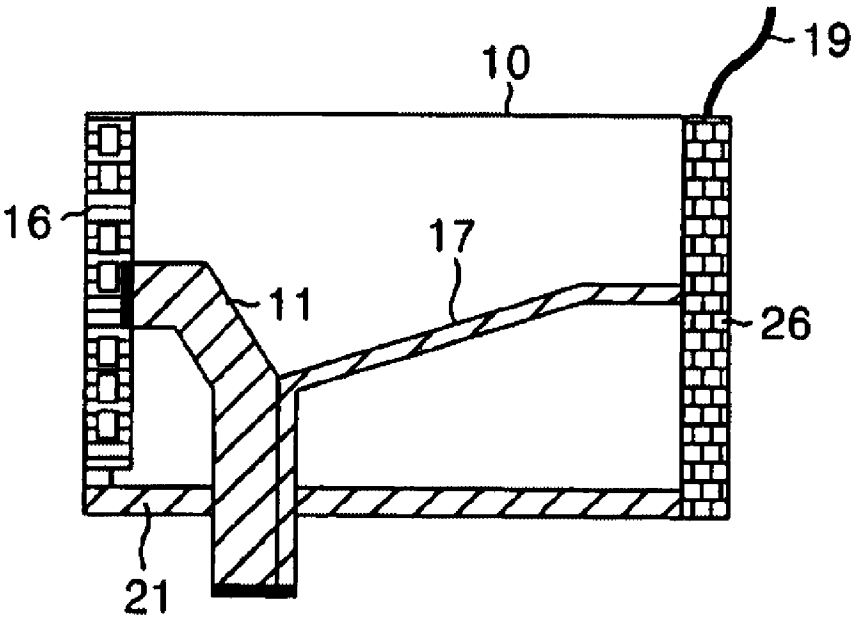
FIG.3B PRIOR ART
FIG. 3B is a view for explaining the bottom surface of the liquid crystal panel shown in FIG. 1.
Figure 4:
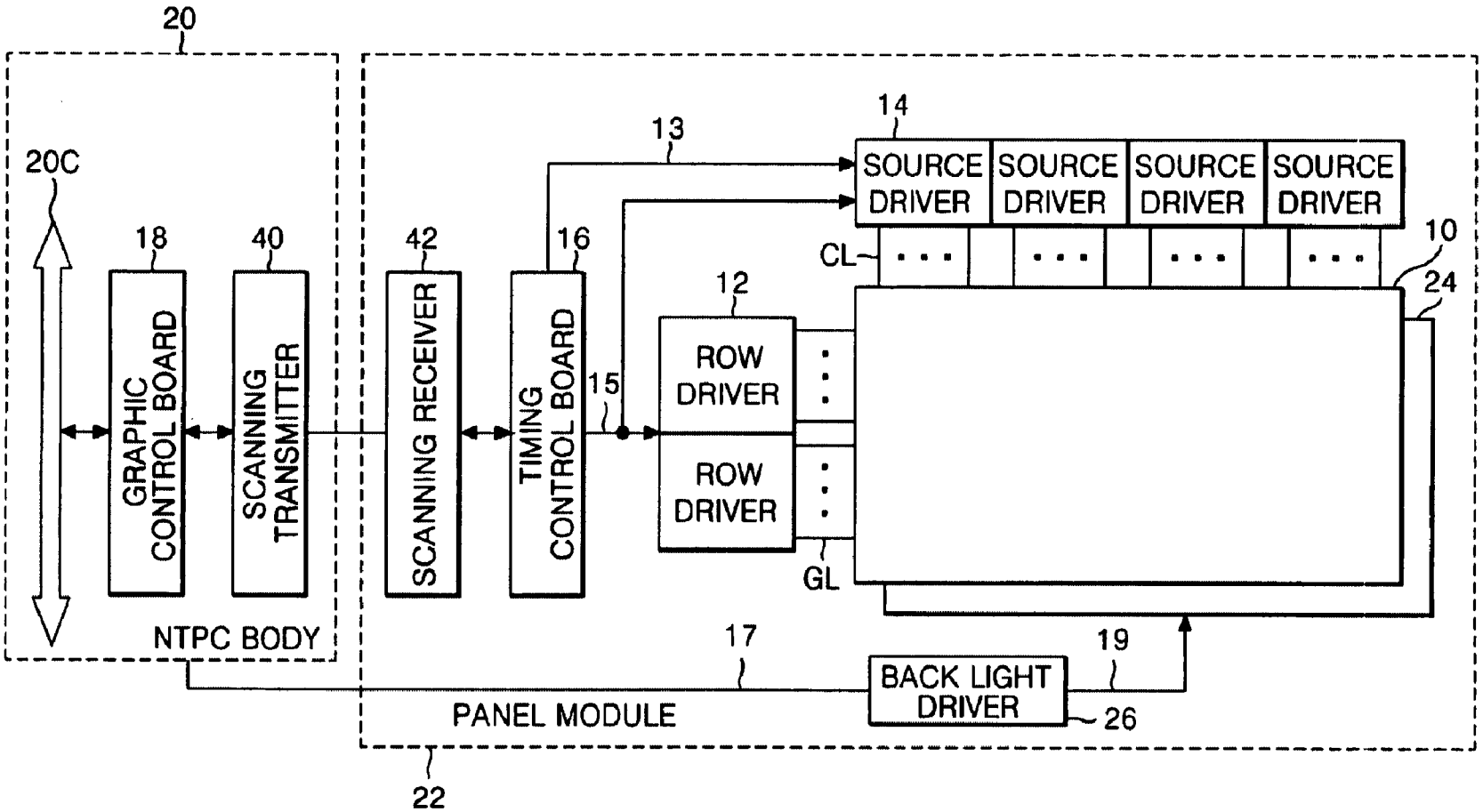
FIG. 4 PRIOR ART
FIG. 4 is a block diagram showing a NTPC with a prior low noise display apparatus.
Figure 5:
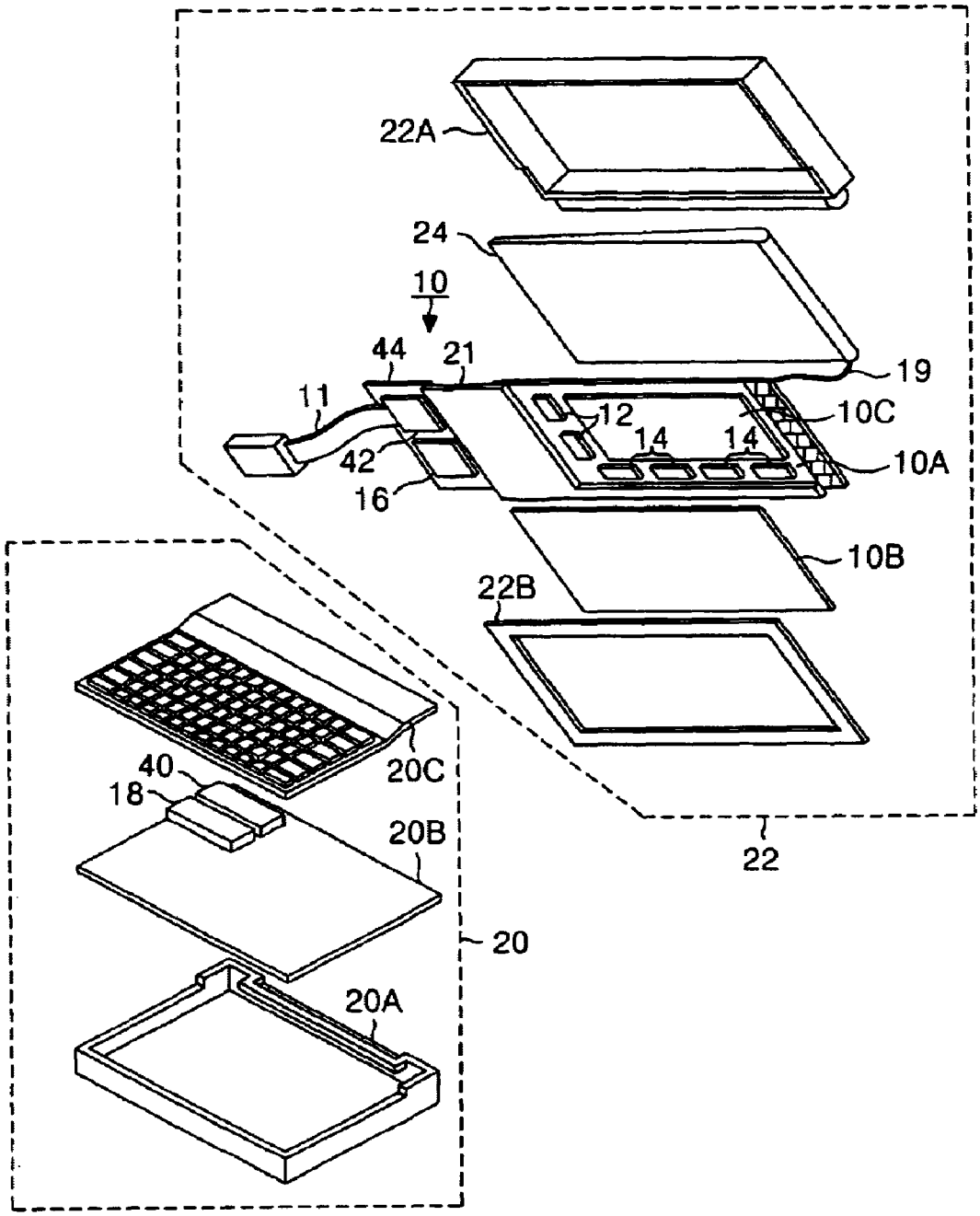
FIG.5 PRIOR ART
FIG. 5 is a view for explaining the structure of the NTPC shown in FIG. 4.
Figure 6:
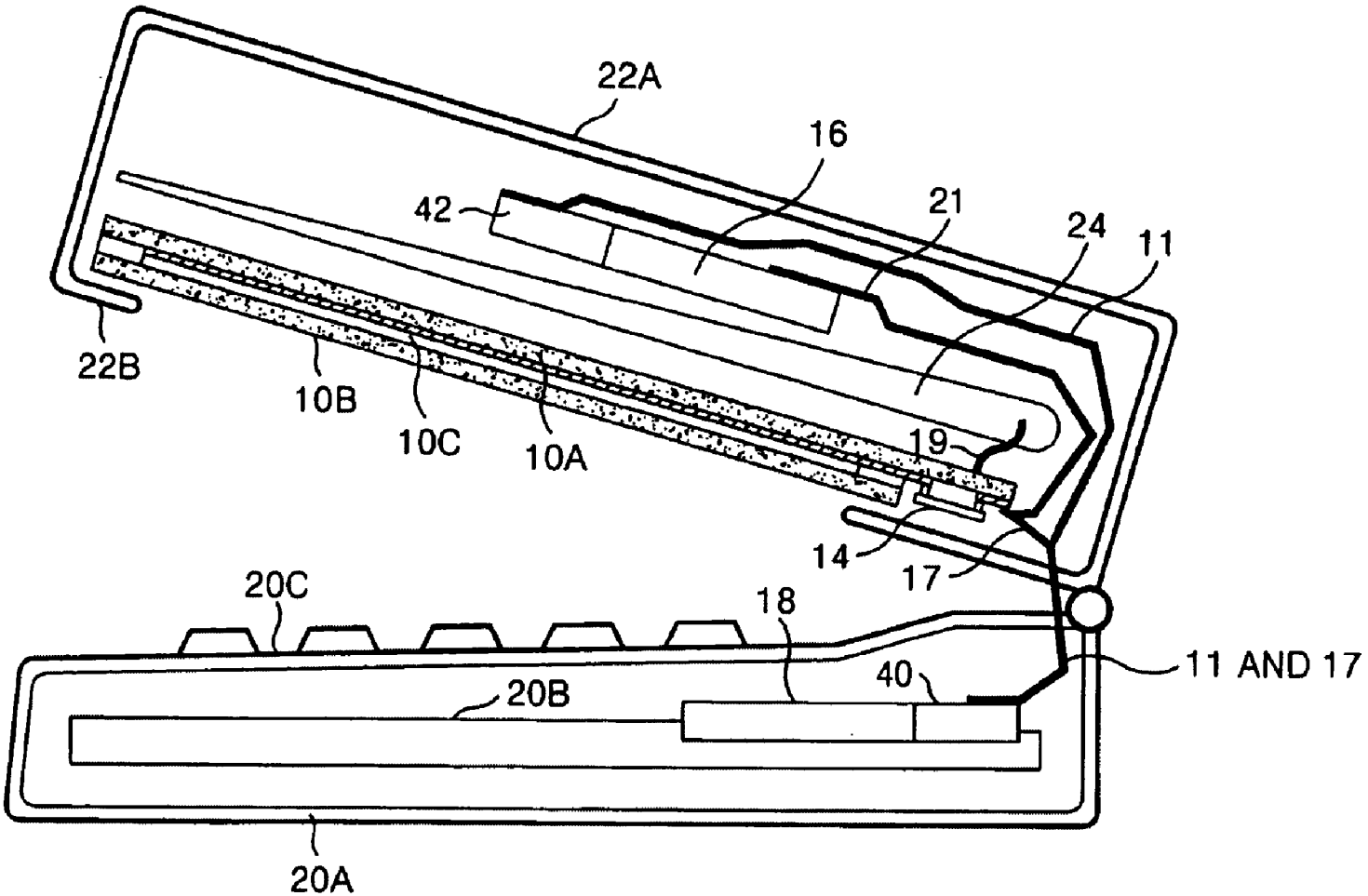
FIG.6 PRIOR ART
FIG. 6 is a sectional view for explaining the structure of the NTPC shown in FIG. 4.
Figure 7:
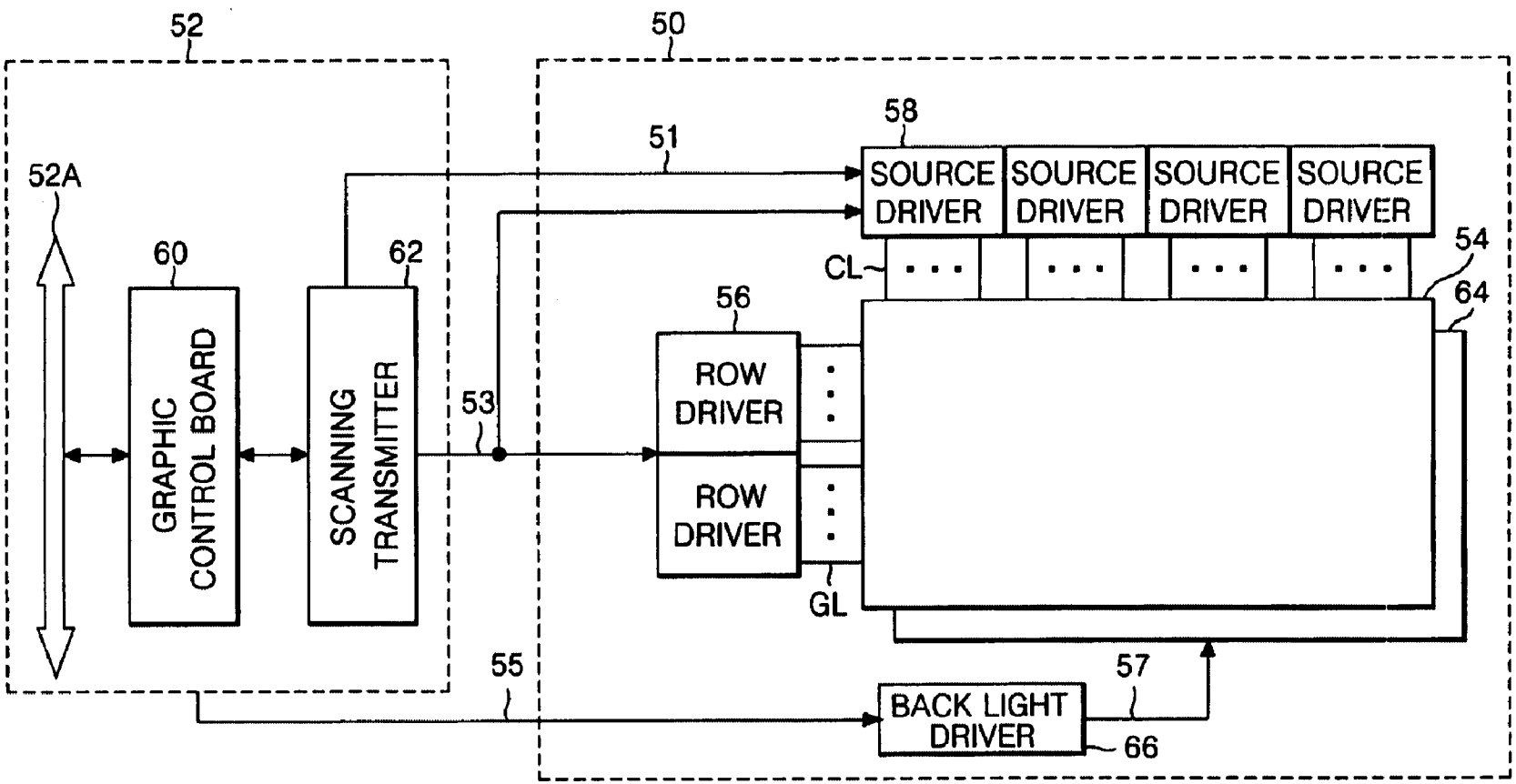
FIG. 7 is a block diagram showing a NTPC with a display apparatus according to an embodiment of present invention.

Referring to FIG. 7, there is shown a NTPC with a display apparatus according to a first preferred embodiment of the present invention. The NTPC includes of a panel module 50 and a NTPC body 52. The panel module 50 includes a liquid crystal panel 54, a plurality of row drivers 56 and a plurality of source drivers 58, as shown in FIG. 7. In the liquid crystal panel 54, a pixel matrix in formed between two glass substrates (not shown). The row drivers 56 drive sequentially row lines GL of the pixel matrix, and the source drivers 58 perform a function of supplying data signals to the column lines CL of the pixel matrix. Meanwhile, the NTPC body 52 includes a graphic control board 60 and a timing control board 62 connected serially to a computer interface bus 52A. The graphic control board 60 converts graphic data into video data to be adaptable for displaying on the liquid crystal panel 54. The video data preferably includes R, G and B data. However, the present invention is not intended to be so limited. These R, G and B data are applied to the source drivers 58 through the timing control board 62 and a data bus 51. The graphic control board 60 also generates a main clock signal, a vertical synchronous signal and a horizontal synchronous signal to be supplied to the timing control board 62. The timing control board 62 generates timing signals for controlling the timing of the row and source drivers 56 and 58 on the basis of the main clock signal, vertical and horizontal synchronous signals. The timing signals are supplied to the row and source drivers 56 and 58 through control lines 53. In addition to the timing signals, the timing control board 62 generates panel voltage signals such as a common voltage signal and so on, gamma compensation voltage signals, and high and low voltage signals for a gate pulse. The gamma compensation voltage signals are applied to the source drivers 56, the high and low voltage signals are supplied to the row drivers 58. The panel driving voltage signals are transmitted to the liquid crystal panel 54, row and source drivers 56 and 58. To this end, the timing control board 62 includes, for example, a timing control circuit chip for performing the data interface and the timing control, a gamma compensation voltage generating circuit for generating the gamma compensation voltage, a scan voltage generating circuit for generating the high and low voltage signals, and a power supply for generating the panel driving voltage signals. The panel module 50 further includes a back light unit 64 for irradiating lights to the liquid crystal panel 54 and a back light driver 66 for driving the back light unit 64. The back light driver 66 responds to signals from the MPCB through a light control line 55 and generates an AC voltage signal to be applied to back light unit 64 through a voltage signal line 57.

In the display apparatus for the NTPC having the circuitry structure, as shown in FIG. 7, the panel module 50 is pivotally secured to the rear edge on the top portion of the NTPC body 52, as shown in FIGS. 8, 9A, 9B and 10. Referring to FIGS. 8, 9A, 9B and 10, the NTPC body 52 includes a main housing 52B loaded with the MPCB 52C, and a keyboard 52D. Arranged On the MPCB 52C included in the main housing 52B, are the graphic control board 60 and the timing control board 62. In the panel module 50, a panel housing 50A is provided with the back light unit 64, liquid crystal panel 54 and a window frame 50B composed in multi-layers. The liquid crystal panel 54 consists of a lower and upper glass substrates 54A and 54B and a pixel matrix 54C between the lower and upper glass substrates 54A and 54B. The lower glass substrate 54A is provided with the row and source drivers 56 and 58 and a FPC film 68. The FPC film 68 connects the liquid crystal panel 54, row and source drivers 56 and 58 with the timing control board 62. Also, the FPC film 68 connects the back light driver 66 with the MPCB 52C. The row drivers 56 are arranged on the left edge of the surface of the lower glass substrate 54A, the source drivers 58 are positioned on the bottom edge of the surface of the lower glass substrate 54. The row and source drivers 56 and 58 drive the pixel matrix 54C of the liquid crystal panel 54 responding to the signals from the timing control board of the MPCB 52C through the FPC film 68. The back light driver 66 secured at right side of the lower glass substrate 54A is provided with the voltage line 57. The back light driver 66 applies the AC voltage signal via the voltage line 57 to the back light unit 64 responding to the light control signal from the MPCB 52C through the FPC film 68. The FPC film 68 transmits the light control signals from the MPCB 52C through the timing control board 62 to the back light driver 66.

In the above-mentioned NTPC, since a FPC film between the graphic control board and timing control board 62 is eliminated, the R, G and B data, the synchronous signals and the clock signal are not affected by noise. Due to this, the picture displayed by the display apparatus will be not distorted. Also, the scanning transmitter and receiver are removed from the NTPC so that the circuitry structure is simplified a number of the elements are decreased and contacts are increased. As a result, the panel module and NTPC can be thicker and the fabricating process of the display apparatus simplified. Alternatively, a similar fabrication process to the related art can be used and a NTPC and panel module will be relatively thinner because of the reduced required elements.

Figure 8:
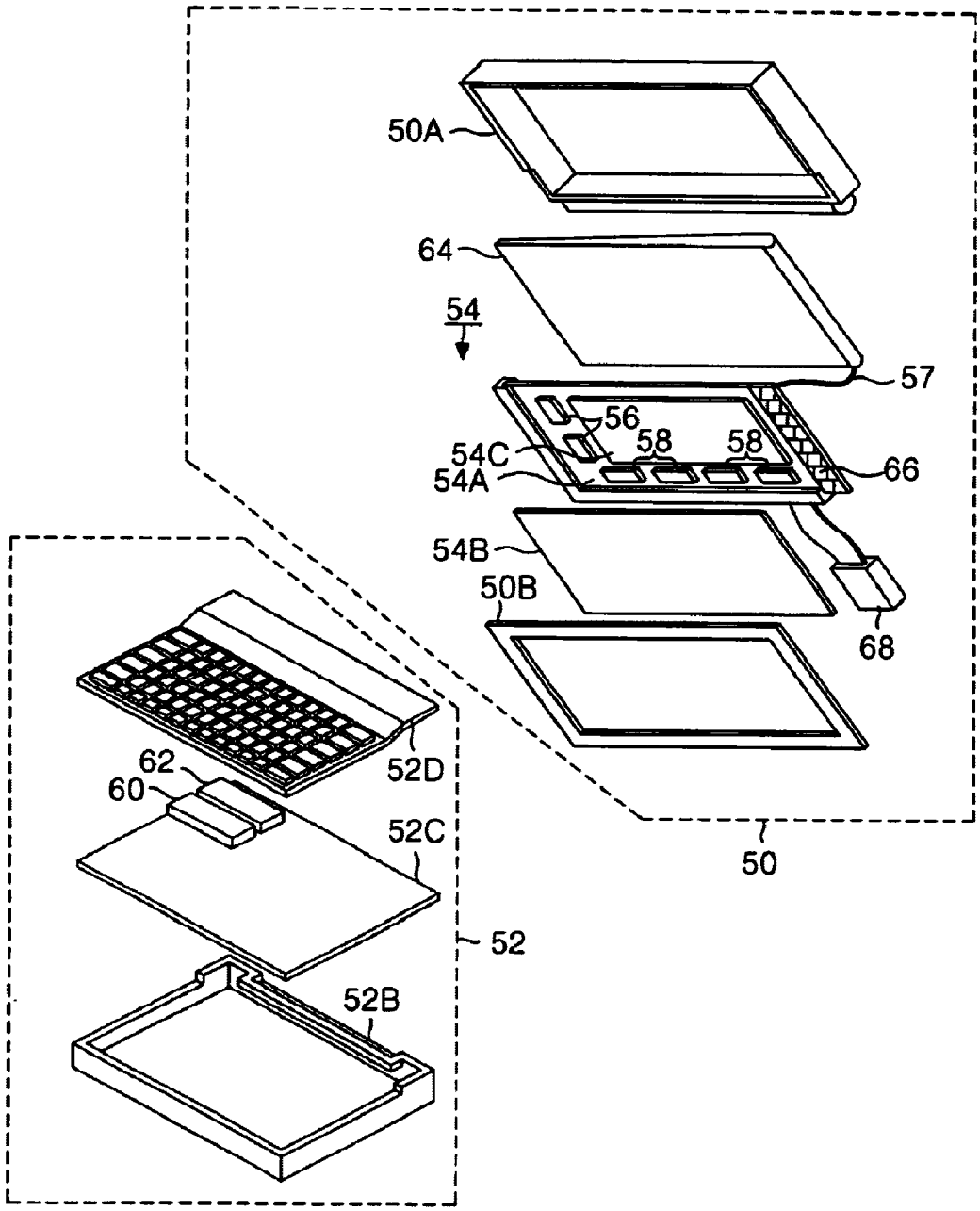
FIG. 8 is a view for explaining the structure of the NTPC shown in FIG. 7.
Figure 9A:
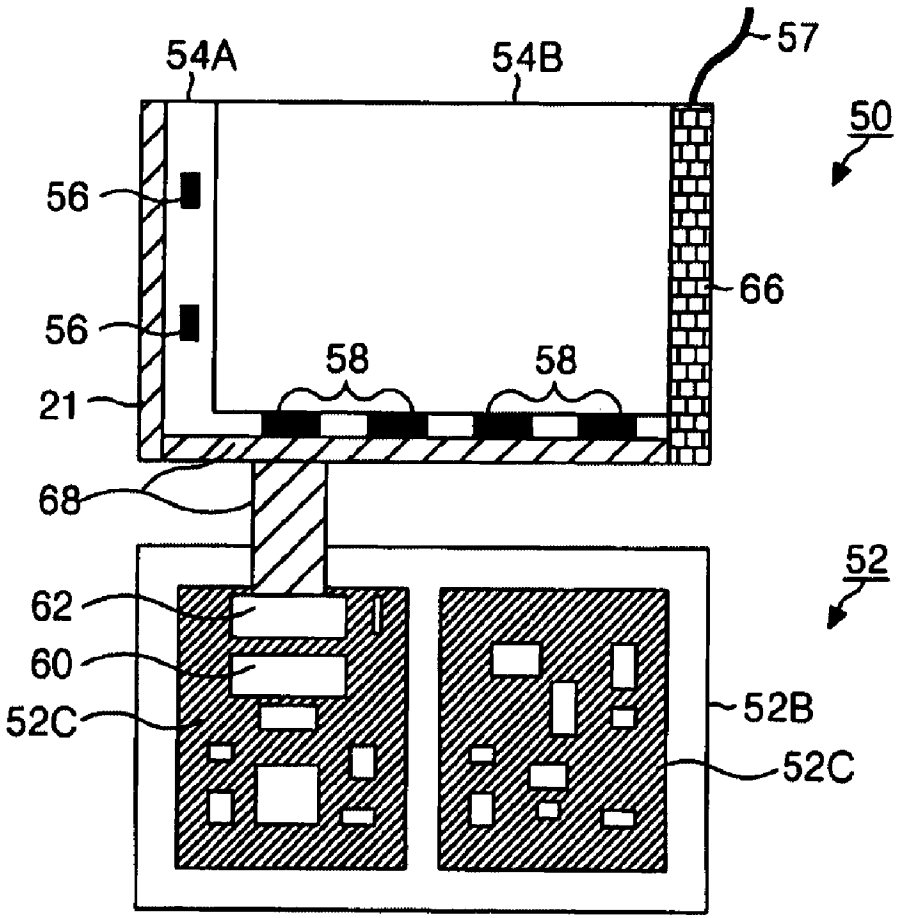
FIG. 9A is a planar view for explaining the structure of the NTPC shown in FIG. 8.
Figure 9B:
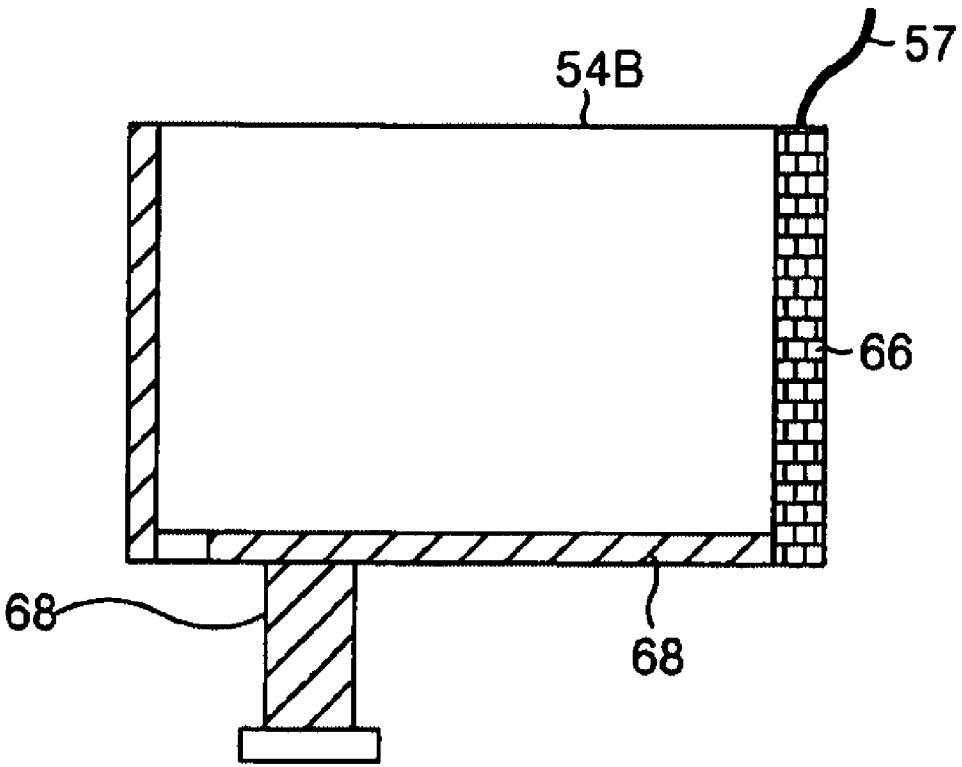
FIG. 9B is a view for explaining the bottom surface of the liquid crystal panel shown in FIG. 8.
Figure 10:
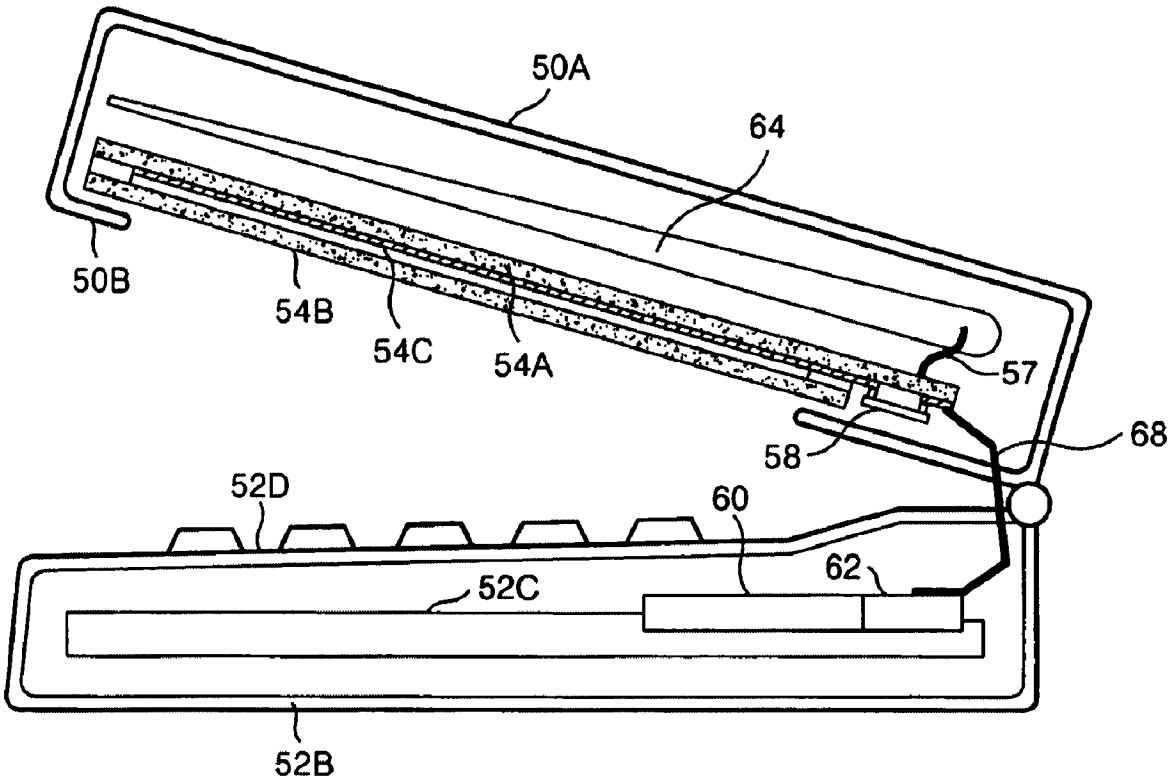
FIG. 10 is a sectional view for explaining the structure of the NTPC shown in FIG. 7.
Figure 11:
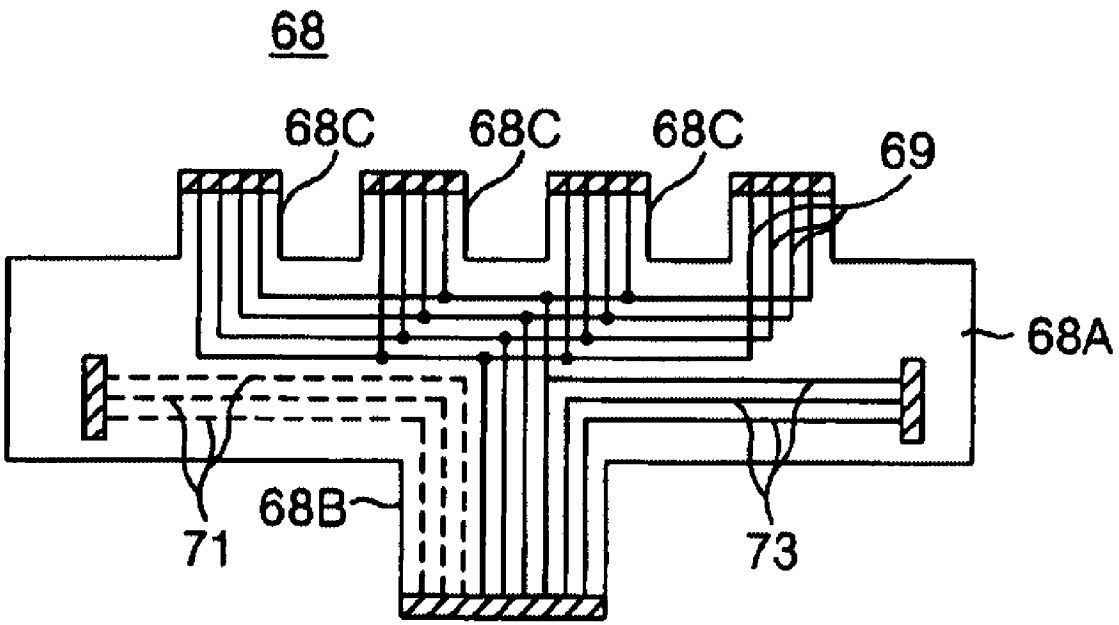
FIG. 11 is a detailed view for explaining the FPC film shown in FIG. 8.

FIG. 11 illustrates the FPC film 68 shown in FIGS. 8, 9A and 10, in detail. The FPC film 68 includes of a wiring base 68A, a neck portion 68B extended from one longitudinal side of wiring base 68A and a number of connection taps 68C extended from one longitudinal side end of the wiring base 68A. The wiring base 68A is provided with first through third wirings 69, 71 and 73. The first wiring 69 is extended from the end of the neck portion 68B to each of the number of the connection taps so that the source drivers 58 is electrically connected with the timing control board 62 through the MPCB 52B. The second wiring 71 which is extended from the end of the neck portion 68B to one short side end of the wiring base 68A, connects the row drivers 56 with the timing control board 62 through the MPCB 52C. The third wiring 73 is also extended from the end of the neck portion 68B to another short side end of the wiring base 68A to connect the back light driver 66 with the MPCB 52C.

Figure 12:
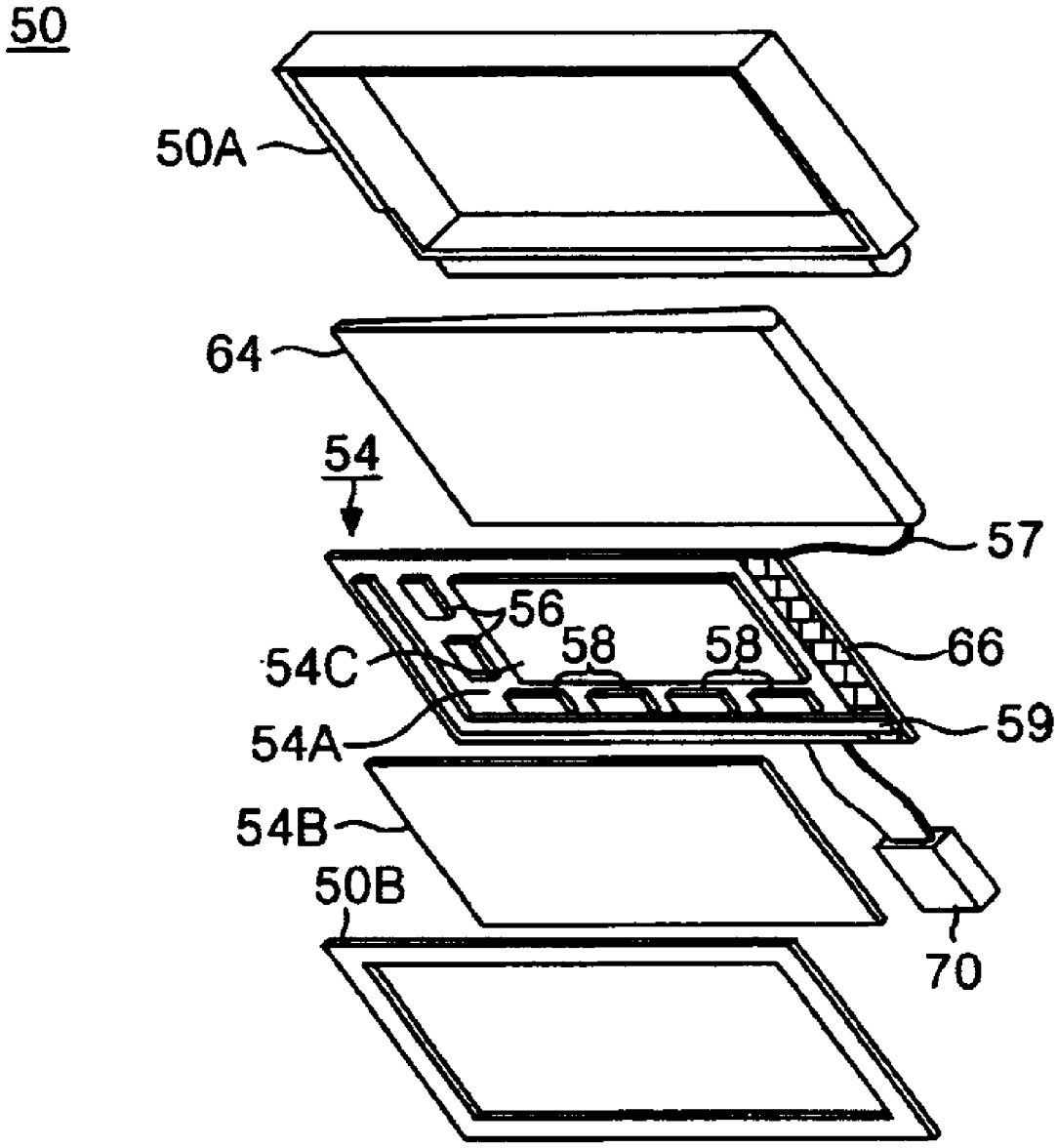
FIG. 12 is a view for explaining another embodiment of the panel module shown in FIG. 7.

FIG. 12 illustrates another embodiment of the panel module 50 shown in FIG. 7. The panel module of FIG. 12 is similar to the panel module 50 of FIG. 7 in structure. There is difference that a printed wire 59 is formed on the left and bottom edges of the surface of the lower glass substrate 54A to connect a FPC film 70 with the row and source drivers 56 and 58. The FPC film 70 is provided with one end coupled to a part of the printed wire 59 and other end connected to the timing control board 62. The FPC film 70 is connected to the MPCB 52C through the timing control board 62. The signals generated in the timing control board 62 are applied to the printed wire 59 through the FPC film 70, and the signal output from the MPCB 52C is supplied to the printed wire 59 through the timing control board 62 and FPC film 70. The printed wire 59 transmits the signals generated in the timing control board 62 to the row and source drivers 56 and 58 and the signals output from the MPCB 52C to the back light driver 66.

In the panel module 50 having the structure as shown in FIG. 12, since the signals generated in the timing control board 62 and MPCB 52C are divided by the printed wire 59 to be applied the row and source drivers 56 and 58 and the back light driver 66, the FPC film 70 can be simplified.

Figure 13:
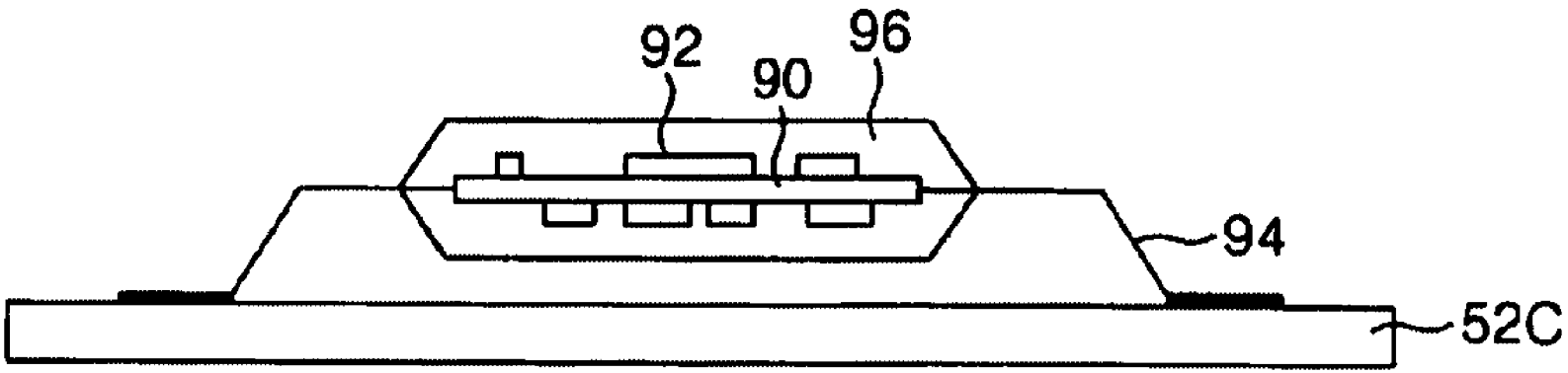
FIG. 13 is a view for explaining one embodiment of the timing control board shown in FIG. 8.

FIG. 13 illustrates an embodiment of the timing control board 62 shown in FIGS. 7 through 11. The timing control board 62 is preferably fabricated in the DIP (dual inline package) or QFP (quad frame package). However, the present invention is not intended to be so limited. The timing control board 62 includes a circuit board 90 and circuit elements 92 on the upper and lower surfaces of the circuit board 90. The circuit elements 92 on the circuit board 90 are electrically connected to each other. The circuit board 90 with the circuit elements 92 are molded by a molding material 94 such as plastic and so on. Also, the timing control board 62 has leads 96 for connecting the circuit board 90 with the MPCB 52C. Each of the leads has one end connected to a part of the circuit elements 92 through the molding material 94 and the circuit board 90 and other end contacted with each contact pad of the MPCB 52C.

Figure 14:
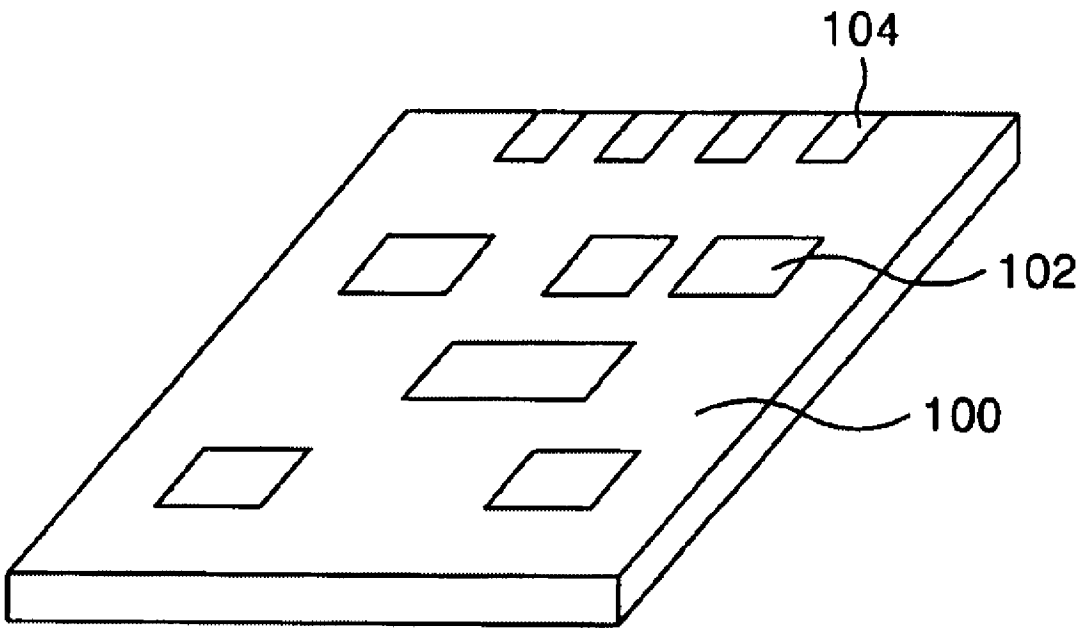
FIG. 14 is a view for explaining another embodiment of the timing control board shown in FIG. 8.

FIG. 14 illustrates another embodiment of the timing control board 62 shown in FIGS. 7 through 11. The timing control board 62 is fabricated in the circuitry card. The timing control board 62 includes a card 100 and circuit elements 102 on the surfaces of the card 100. The circuit elements 102 on the card 100 are electrically connected to each other. The card 100 is provided with slot contacts 104. The slot contacts 104 are contacted with a slot socket (not shown) so that the circuit elements 102 on the card 100 are connected with the MPCB 52B.

Figure 15:
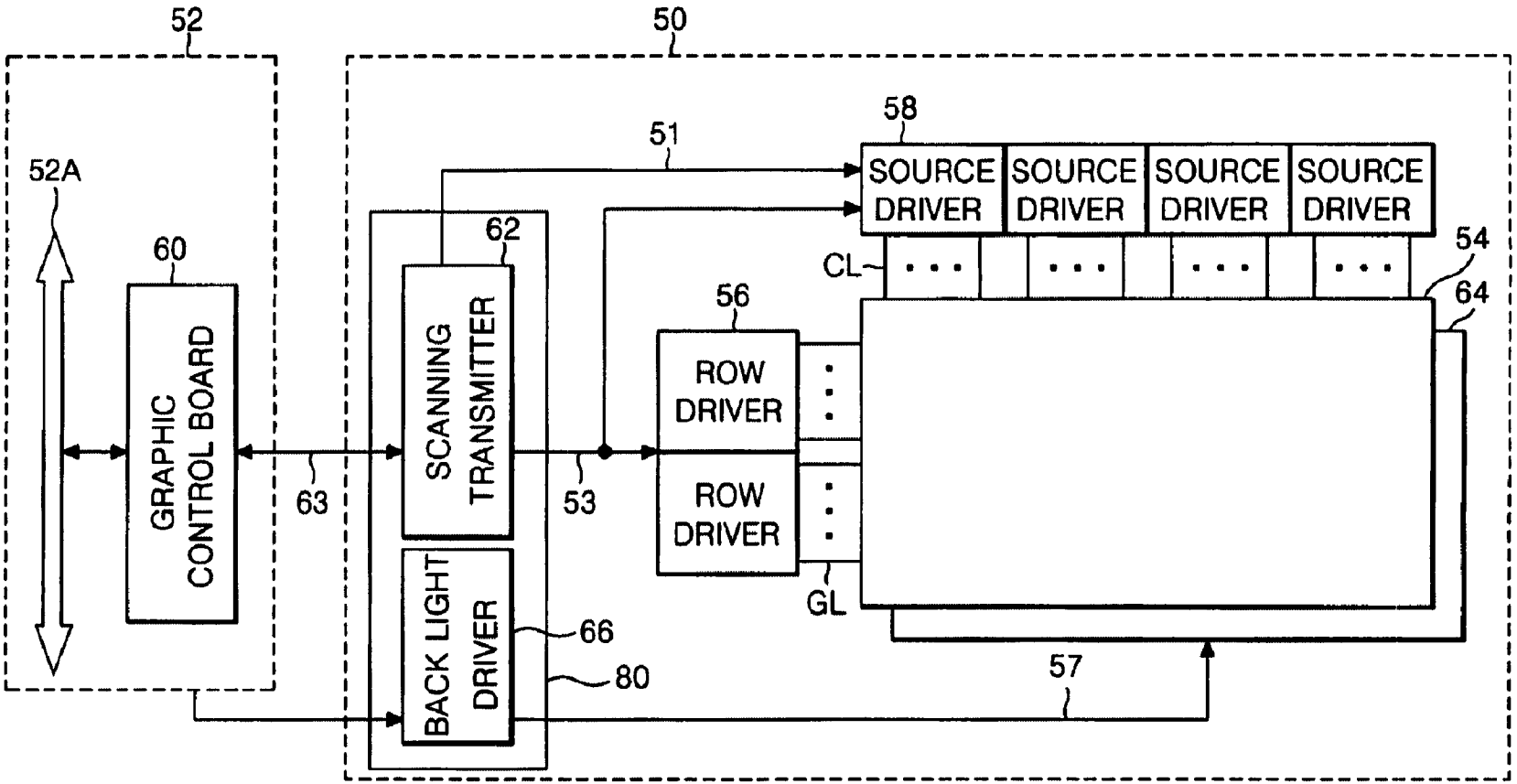
FIG. 15 is a block diagram showing a NTPC with a display apparatus according to another embodiment of present invention.

In the FIG. 15, there is illustrates a NTPC with a display apparatus according to a second preferred embodiment of the present invention. The NTPC includes a panel module 50 with a panel printed circuit board 80 positioned between a panel module 50, and NTPC body 52. The panel module 50 is provided with a liquid crystal panel 54 and a back light unit 64. The liquid crystal panel 54 is provided with a plurality of row drivers 56 and a plurality of source drivers 58. In the liquid crystal panel 54, a pixel matrix in formed between two glass substrates (not shown). The row drivers 56 drive sequentially row lines GL of the pixel matrix, and the source drivers 58 perform a function of supplying data signals to the column lines CL of the pixel matrix. The back light unit 64 irradiates to the lower surface of the liquid crystal panel 54 responding to an AC voltage signal. Meanwhile, the NTPC body 52 includes a graphic control board 60 connected to a computer interface bus 52A. The graphic control board 60 converts graphic data into video data to be adaptable for displaying on the liquid crystal panel 54. The video data consists of R, G and B data. These R, G and B data are applied to the source drivers 58 through a slot bus 63, the panel printed circuit board 80 and a data bus 51. The graphic control board 60 also generates a main clock signal, a vertical synchronous signal and a horizontal synchronous signal to be supplied to the panel printed circuit board 80. Further, the panel printed circuit board 80 includes a timing control board 62 and a back light driver 66. The timing control board 62 receives the R, G and B data, the main clock signal, and the vertical and horizontal synchronous signals from the graphic control board 60 through the slot bus 63. The timing control board 62 transmits the R, G and B data via the data bus 51 and generates timing signals for controlling the timing of the row and source drivers 56 and 58 on the basis of the main clock signal, vertical and horizontal synchronous signals. The timing signals are supplied to the row and source drivers 56 and 58 through control lines 53. In addition to the timing signals, the timing control board 62 generates panel voltage signals such as a common voltage signal and so on, gamma compensation voltage signals, and high and low voltage signals for a gate pulse. The gamma compensation voltage signals are applied to the source drivers 56, the high and low voltage signals are supplied to the row drivers 58. The panel driving voltage signals are transmitted to the liquid crystal panel 54, row and source drivers 56 and 58. To this end, the timing control board 62 includes a timing control circuit chip for performing the data interface and the timing control, a gamma compensation voltage generating circuit for generating the gamma compensation voltage, a scan voltage generating circuit for generating the high and low voltage signals, and a power supply for generating the panel driving voltage signals. The back light driver 66 responds to signals from the MPCB through a light control line 55 and generates an AC voltage signal to be applied to back light unit 64 through a voltage signal line 57.

Figure 16:
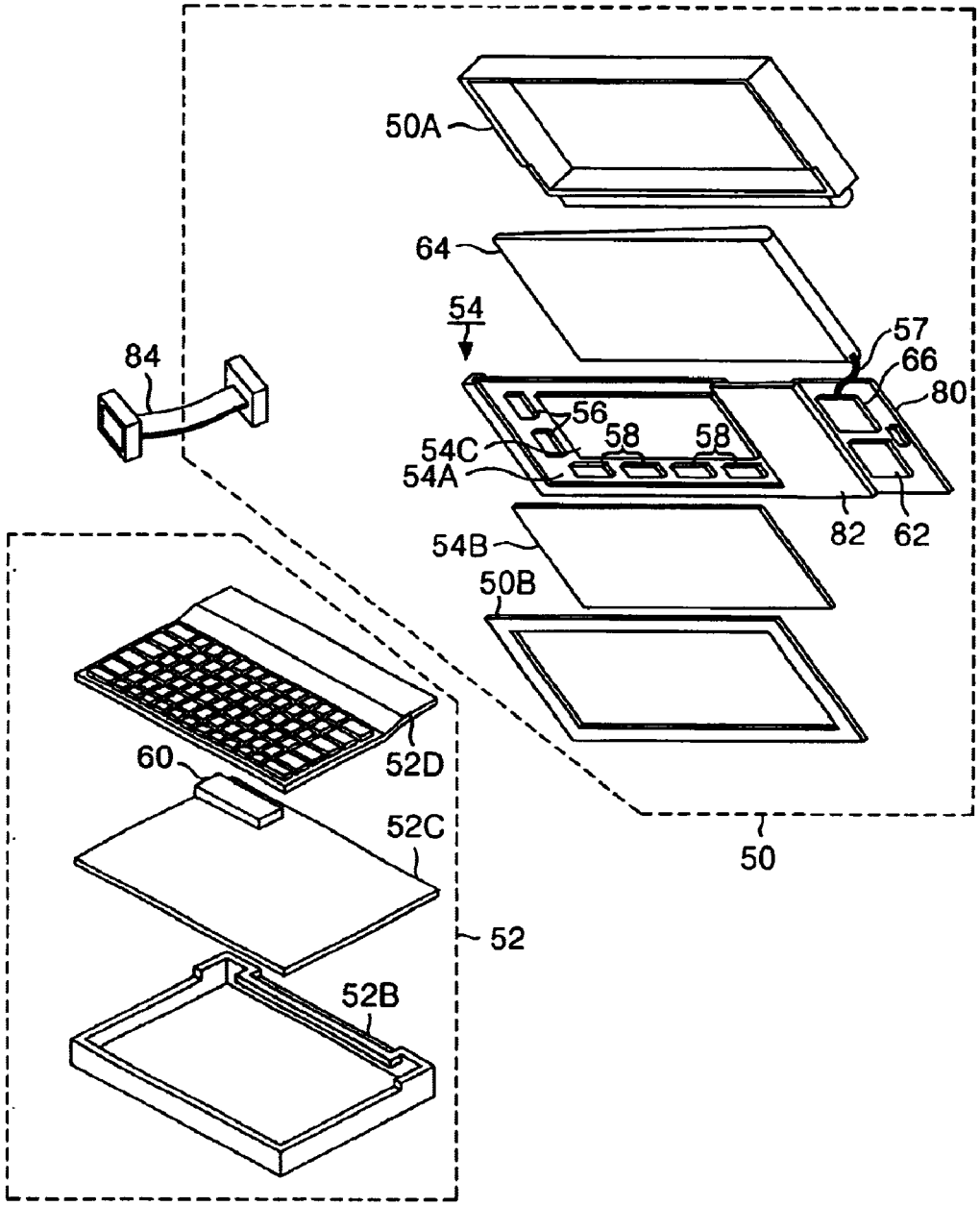
FIG. 16 is a view for explaining the structure of the NTPC shown in FIG. 15.
Figure 17A:
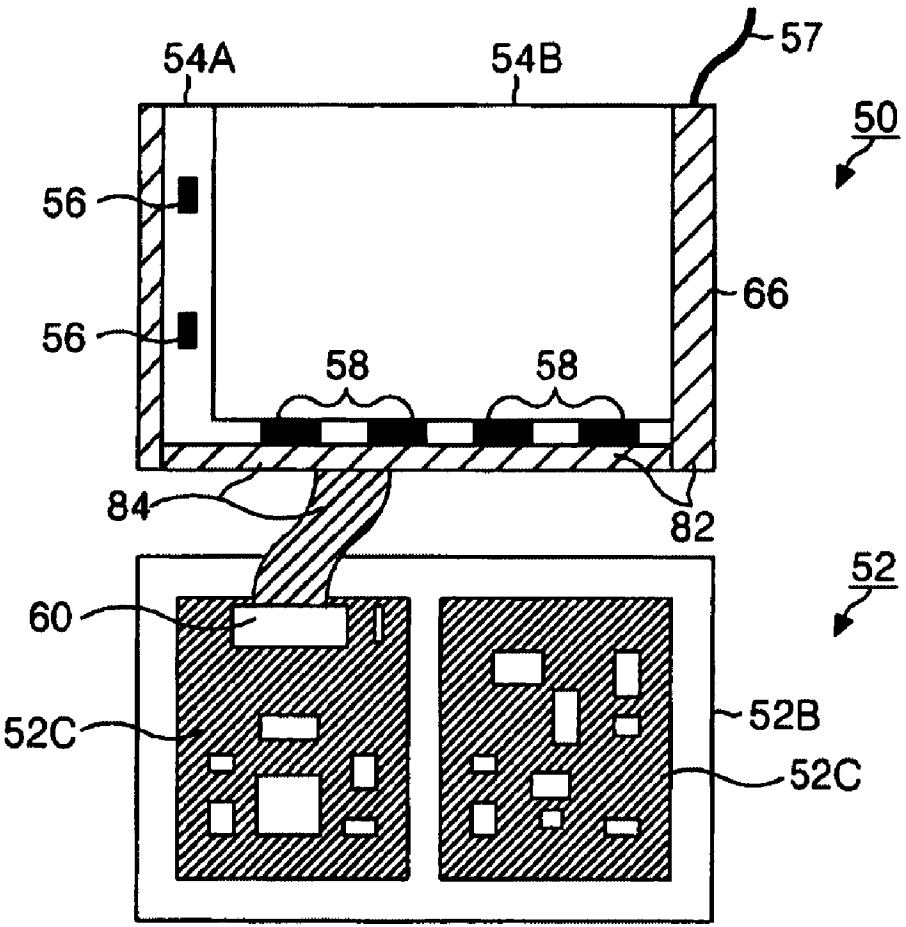
FIG. 17A is a planar view for explaining the structure of the NTPC shown in FIG. 16.
Figure 17B:
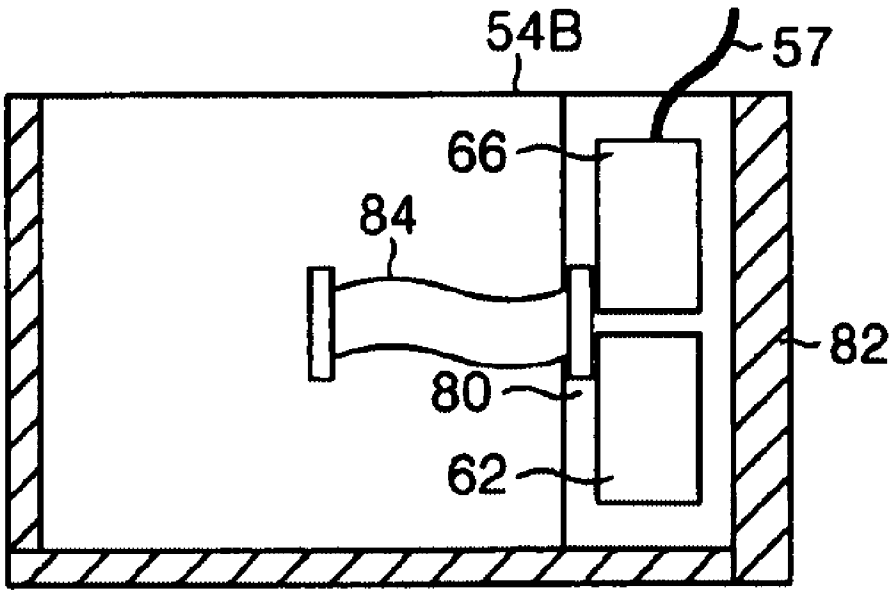
FIG. 17B is a view for explaining the bottom surface of the liquid crystal panel shown in FIG. 16.

In the display apparatus for the NTPC having the circuitry structure, as shown in FIG. 15, the panel module 50 is pivotally secured to the rear edge on the top portion of the NTPC body 52, as shown in FIGS. 16, 17A, and 17B. Referring to FIGS. 16, 17A and 17B, the NTPC body 52 includes a main housing 52B loaded with the MPCB 52C, and a keyboard 52D. The MPCB 52C of the main housing 52B includes a graphic control board 60 positioned thereon. In the panel module 50, a panel housing 50A is provided with the back light unit 64, liquid crystal panel 54 and a window frame 50B composed in multi-layers. The liquid crystal panel 54 includes a lower and upper glass substrates 54A and 54B and a pixel matrix 54C between the lower and upper glass substrates 54A and 54B. The lower glass substrate 54A is provided with the row and source drivers 56 and 58 and first FPC film 82. The first FPC film 82 connects the liquid crystal panel 54, row and source drivers 56 and 58 with the timing control board 62 of the panel printed control board 80. The row drivers 56 are arranged on the left edge of the surface of the lower glass substrate 54A, and the source drivers 58 are arranged on the bottom edge of the surface of the lower glass substrate 54. The row and source drivers 56 and 58 drive the pixel matrix 54C of the liquid crystal panel 54 responding to the signals from the timing control board of the panel printed circuit board 80 through the first FPC film 82. The first FPC film 82 is coupled to the right side (i.e. the side opposite to the row drivers 56) of the lower glass substrate 54A and includes the data bus 51 and control lines 53. The panel printed circuit board 80 is provided with second FPC film 84 and the voltage signal line 57. Also, the panel printed circuit board 80 has the timing control board 62 and back light driver 66. The timing control board 62 receives the R, G and B data, the main clock signal, and the vertical and horizontal synchronous signal from the graphic control board 60 of the MPCB 52C through the second FPC film 84. The timing control board 62 transmits the R, G and B data and the timing control signal via the first FPC film 82 to the row and source drivers 56 and 58. The back light driver 66 applies the AC voltage signal via the voltage line 57 to the back light unit 64 responding to the light control signal from the MPCB 52C through the second FPC film 84. The second FPC film 84 preferably has the light control line 55 and the slot bus 63.

In the above-mentioned NTPC, since the back light driver 66 is positioned on the panel printed circuit board 80 instead of the side of the liquid crystal panel 54, the effective screen area of the panel module 50 is wide.

Figure 18:
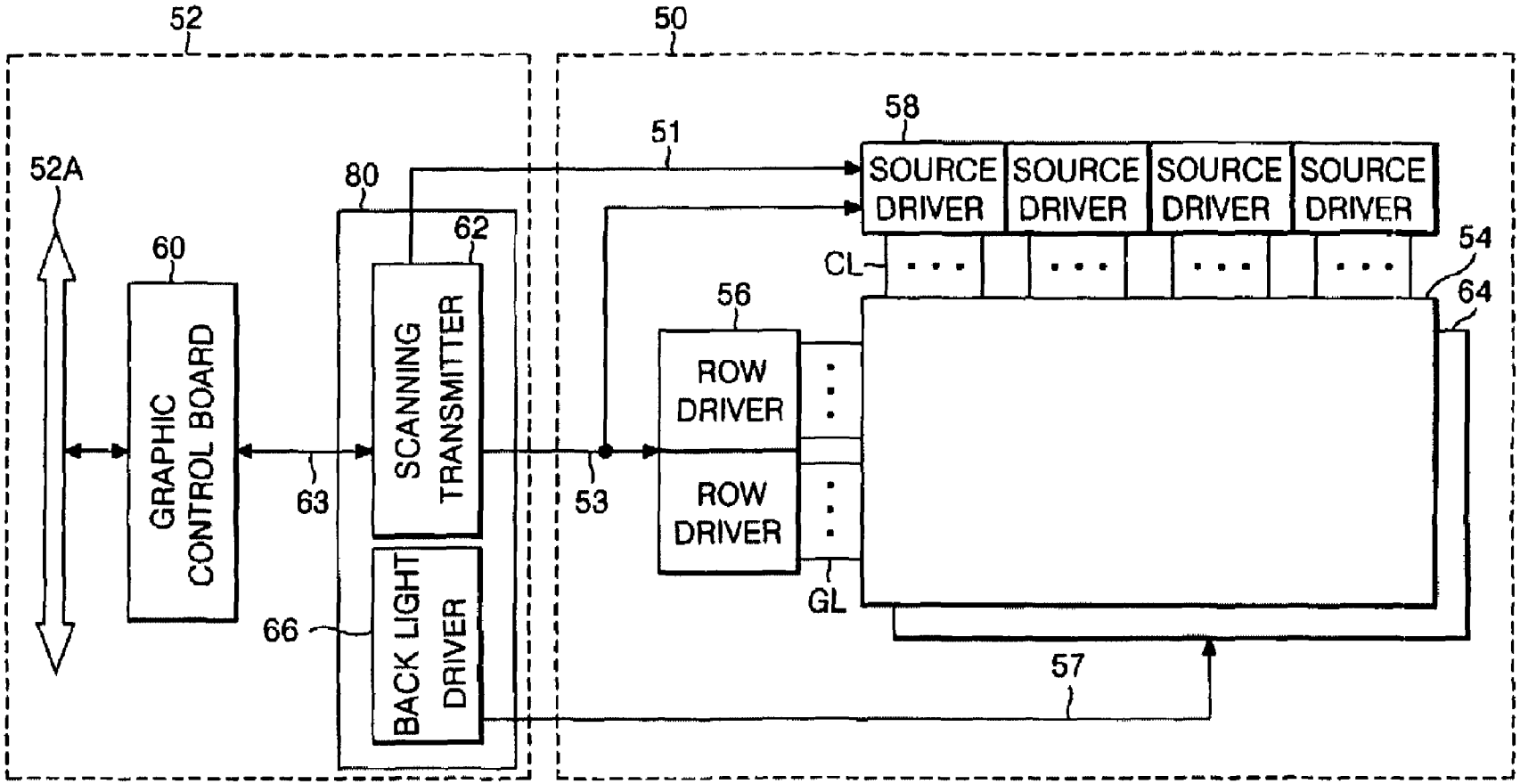
FIG. 18 is a block diagram showing a NTPC with a display apparatus according to another embodiment of present invention.
Figure 19:
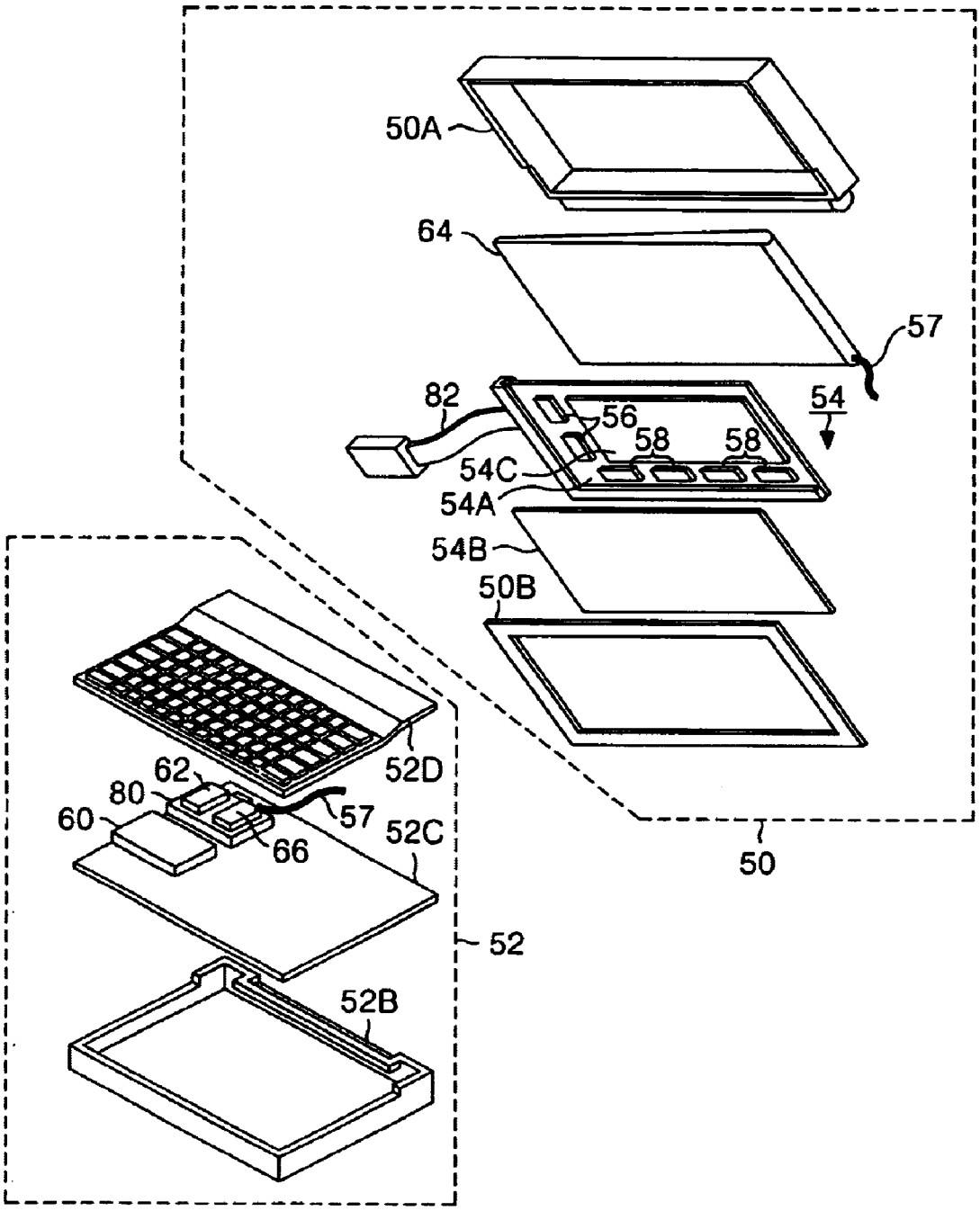
FIG. 19 is a view for explaining the structure of the NTPC shown in FIG. 18.

FIG. 18 shows a NTPC with a display module according to a third preferred embodiment of the present invention. The NTPC of FIG. 18 is similar to the NTPC of the FIG. 15. The NTPC has differences that the panel printed circuit board 80 is removed from the panel module 50 to the NTPC body 52, and the slot bus 63 and the light control line 55 are eliminated. In the NTPC of FIG. 19, the effective screen area is wide and the R, G and B data of the picture displayed by the conventional display apparatus will not be distorted. These advantages may be apparent through the following description of FIGS. 19, 20A and 20B.

Figure 20A:
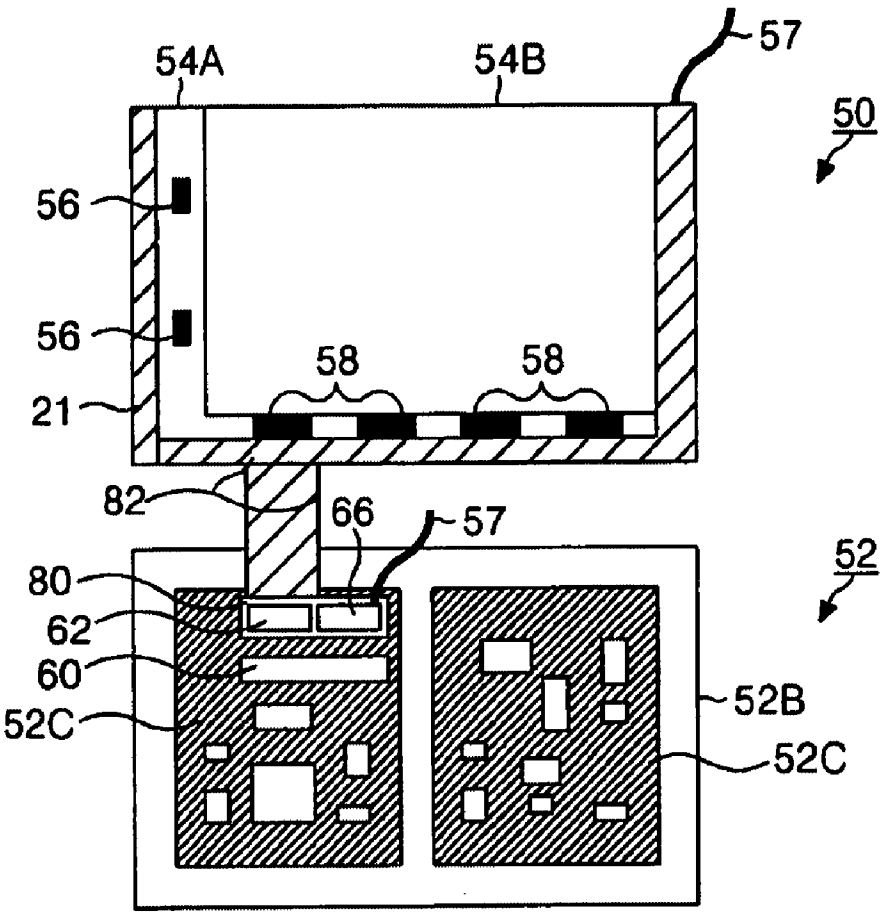
FIG. 20A is a planar view for explaining the structure of the NTPC shown in FIG. 19.
Figure 20B:
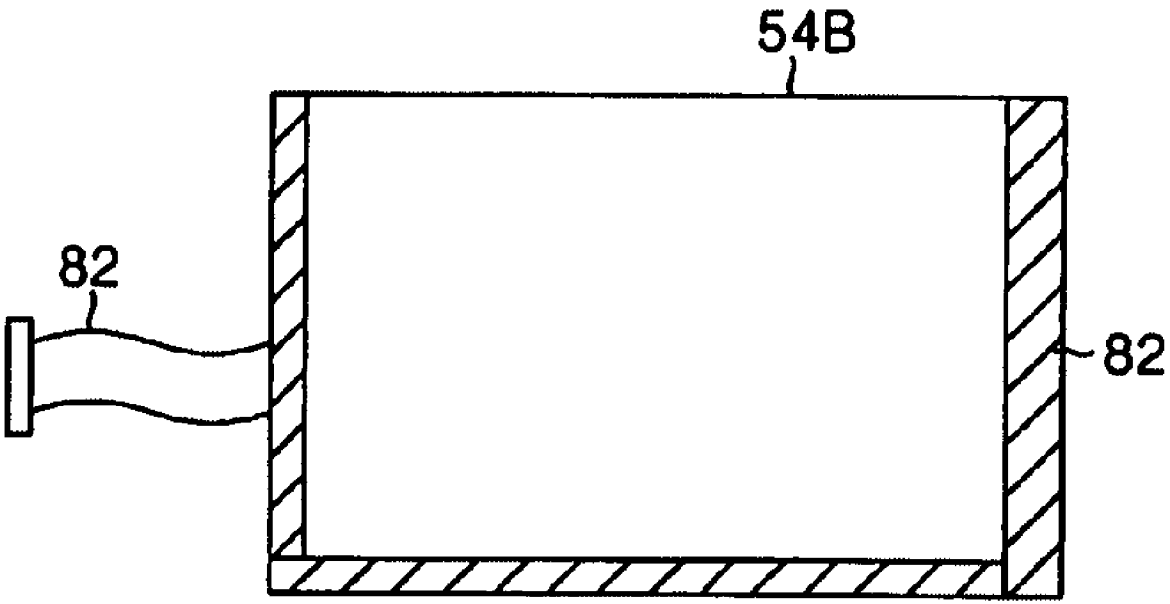
FIG. 20B is a view for explaining the bottom surface of the liquid crystal panel shown in FIG. 19.

Referring to FIGS. 19, 20A and 20B, the panel module 50 is pivotally secured to the rear edge on the top portion of the NTPC body 52. The NTPC body 52 includes a main housing 52B loaded with the MPCB 52C, and a keyboard 52D. Arranged on the MPCB 52C included in the main housing 52B, are the graphic control board 60 and the panel printed circuit board 80. The panel printed circuit board 80 is provided with the timing control board 62 and the back light driver 66. In the panel module 50, a panel housing 50A is provided with the back light unit 64, liquid crystal panel 54 and a window frame 50B composed in multi-layers. The liquid crystal panel 54 includes a lower and upper glass substrates 54A and 54B and a pixel matrix 54C between the lower and upper glass substrates 54A and 54B. The lower glass substrate 54A is provided with the row and source drivers 56 and 58 and a FPC film 82. The FPC film 82 connects the liquid crystal panel 54, row and source drivers 56 and 58 with the timing control board 62 of the MPCB 52C. The row drivers 56 are arranged on the left edge of the surface of the lower glass substrate 54A, the source drivers 58 are positioned on the bottom edge of the surface of the lower glass substrate 54. The row and source drivers 56 and 58 drive the pixel matrix 54C of the liquid crystal panel 54 responding to the signals from the timing control board 62 of the MPCB 52C through the FPC film 82. The FPC film 82 has the data bus 51 and control lines 53 shown in FIG. 19. The back light driver 66 applies the AC voltage signal via the voltage line 57 to the back light unit 64 responding to the light control signal from the MPCB 52C.

In the above-mentioned NTPC, since a FPC film between the graphic control board and timing control board 62 is eliminated, the R, G and B data, the synchronous signals and the clock signal are not affected by noise. Due to this, the picture displayed by the display apparatus will not be distorted. Also, the scanning transmitter and receiver are removed from the NTPC so that the circuitry structure is simplified a number of the elements are decreased and contacts are increased. As a result, the panel module and NTPC are thick and the fabricating process of the display apparatus is simplified. Furthermore, the effective screen area of the panel module 50 is wide because the back light driver 66 is positioned on the panel printed circuit board 80 instead of the side of the liquid crystal panel 54.

As described above, in the display apparatus according to the preferred embodiments according to the present invention, since a FPC film between the graphic control board and timing control board is eliminated, the R, G and B data, the synchronous signals and the clock signal are not affected by noise. Due to this, the picture displayed by the display apparatus of the present invention is not distorted. Also, the scanning transmitter and receiver are removed from the NTPC so that the circuitry structure is simplified and a number of the elements are decreased. As a result, the panel module and NTPC are thick and the fabricating process of the display apparatus is simplified. Alternatively, a similar fabrication process to the related art can be used and a NTPC and panel module will be relatively thinner because of the reduced required elements. Furthermore, the effective screen area of the panel module is wide because the back light driver is positioned on the panel printed circuit board instead of the side of the liquid crystal panel.

Although the present invention has been explained by the embodiments shown in the drawing hereinbefore, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A display apparatus for a notebook computer having a system body with a main printed circuit board, comprising:

a panel module including a display panel and a back light unit for irradiating to the display panel, said display panel having a pixel matrix that displays a picture information processed by the main printed circuit board, said panel module further including drivers mounted on the display panel that drive the pixel matrix;

a module control board having a timing control unit for driving the drivers and a back light unit driver for driving the back light unit of the panel module;

a first connecting device that connects the timing control unit and back light unit driver of the module control board with the drivers and the back light unit of the panel module, wherein said first connecting device includes a flexible printed circuit film; and a second connecting device that connects the main printed circuit board with the module control board to provide signals from the main printed circuit board to the module control board.

2. The display apparatus as claimed in claim 1, wherein said second connecting device includes:

a flexible printed circuit film being coupled between the drivers and the module control board; and a conductive line being connected between the module control board and the back light unit.

3. A notebook computer, comprising:

a display module, wherein the display module comprises, a display device that displays data, and drivers mounted in the display module that drive the display device;

a body module, wherein the body module comprises, a main printed circuit board that processes the data for the display device, and a driving circuit mounted on the main printed circuit board that drives the drivers in the display module; and a connecting circuit that connects the drivers and a back light unit with the driving circuit, wherein said connecting circuit comprises, a flexible printed circuit film that connects between the drivers and the driving circuit, and a conductive line that connects between the driving circuit and the back light unit, wherein the display module further comprises the back light unit that irradiates the display device, and wherein the driving circuit is a module control board mounted on the main printed circuit board, and wherein the module control board drives the back light unit.

4. The notebook computer of claim 3, wherein the conductive line connects the back light unit with the module control board.

5. The notebook computer of claim 3, wherein the driving circuit includes a timing control circuit and forms a package.

6. The notebook computer of claim 5, wherein the driving circuit comprises:

a circuit board mounting circuit elements;

a molding material that packages the circuit board with the circuit elements; and a plurality of leads coupled to the circuit board through the molding material.

7. The notebook computer of claim 3, wherein the driving circuit is formed in a circuit card.

8. The notebook computer of claim 7, wherein the driving circuit comprises:

a card;

a plurality of circuit elements mounted on the card; and a plurality of slot contacts being formed on the card.

9. The notebook computer of claim 3, wherein the body module comprises a data entry device, wherein the data entry device is a keyboard, wherein the display module is rotatably coupled to the body module to move between at least an open position and a closed position, wherein the display device comprises a pixel matrix having a plurality of pixel cells that use row and column lines for selection, and wherein the drivers comprise a plurality of row drivers and a plurality of column drivers.

10. The notebook computer of claim 3, wherein the display module has a reduced thickness.

* * * * *